US006926579B2

(12) United States Patent
Rappaport

(10) Patent No.: US 6,926,579 B2
(45) Date of Patent: Aug. 9, 2005

(54) TOY ROCKET LAUNCH PAD WITH DIRECTIONAL SAFETY VALVE

(76) Inventor: Mark Rappaport, 1817 Aston Ave. - Suite 103, Carlsbad, CA (US) 92008-7339

( * ) Notice: Subject to any disclaimer, the term of this patent is extended or adjusted under 35 U.S.C. 154(b) by 0 days.

(21) Appl. No.: 10/915,748

(22) Filed: Aug. 11, 2004

(65) Prior Publication Data

US 2005/0085153 A1 Apr. 21, 2005

Related U.S. Application Data

(60) Provisional application No. 60/496,203, filed on Aug. 19, 2003.

(51) Int. Cl.[7] ..... A63H 27/26

(52) U.S. Cl. ..... 446/212; 446/231; 446/429; 124/64

(58) Field of Search ..... 446/176, 212, 446/230, 231, 180, 211, 197, 198; 124/56, 124/63, 64, 83, 84; 244/3.29, 3.28, 63

(56) References Cited

U.S. PATENT DOCUMENTS

| | | | | |
|---|---|---|---|---|
| 2,836,008 | A * | 5/1958 | Nichols | 446/231 |
| 2,918,751 | A * | 12/1959 | Johnson | 89/1.806 |
| 2,993,297 | A * | 7/1961 | Bednar et al. | 446/197 |
| 4,038,776 | A * | 8/1977 | Filipeli | 446/52 |
| 4,076,006 | A * | 2/1978 | Breslow et al. | 124/64 |
| 4,223,472 | A * | 9/1980 | Fekete et al. | 446/192 |
| 4,897,065 | A * | 1/1990 | Fertig et al. | 446/63 |
| 5,188,557 | A * | 2/1993 | Brown | 446/212 |
| 5,522,756 | A * | 6/1996 | Barthold | 446/193 |
| 6,568,985 | B1 * | 5/2003 | Binkley | 446/176 |

* cited by examiner

*Primary Examiner*—Bena B. Miller
(74) *Attorney, Agent, or Firm*—Dilworth & Barrese, LLP

(57) ABSTRACT

Disclosed herein is an apparatus and method for launching a toy rocket that includes rotating a launch tube about an axis that is parallel with a connecting tube, which is rotatably connected to the launch tube; extending the launch tube in a perpendicular direction; progressively closing a safety valve by rotating the launch tube toward a vertical position, relative to a launch pad assembly; loading the toy rocket onto a distal end of the extended launch tube; and rapidly compressing a bellows in communication with the launch tube.

15 Claims, 8 Drawing Sheets

TOY ROCKET LAUNCH PAD WITH DIRECTIONAL SAFETY VALVE

PRIORITY

The application claims priority to provisional application Ser. No. 60/496,203, which was filed with the U.S. Patent and Trademark Office on Aug. 19, 2003, the contents of which are incorporated herein by reference.

BACKGROUND OF THE INVENTION

1. Field of Invention

The present invention relates generally to a toy rocket launcher and, more particularly, to a toy rocket launcher which is actuated by air or hydraulic pressure.

2. Description of the Related Art

Numerous types of toy rocket launchers are known in the art, with the usefulness and function of each being typically limited by the construction, manner of propulsion and arrangement of the various elements of the launcher and rocket.

Many model rockets use self-propelled, solid fuel rocket engines to propel them into the air. Solid fuel can be dangerous, and if improperly used can cause serious harm to the operator or to spectators.

Less dangerous are pressure-propelled rocket launchers which typically generate a pressure pulse in a base, and transfer the pulse to an inert toy rocket to implement launch. Such launch is typically accomplished by pressurized air or water.

Numerous designs of pressure-propelled rocket launchers have been suggested and implemented. Such pressurized launchers typically operate by release of pressurized water or pressurized air into a launch tube that extends into a hollow of the toy rocket. The pressure pulse that is utilized for launch can be developed in numerous ways, including use of a bellows connected to the launch tube, and use of an air pump to elevate the pressure within a reservoir.

Although less dangerous than rockets having solid fuel propulsion systems, misuse of conventional pressure-propelled rocket launchers can result in injury. Such injury can arise when the toy rockets are launched in a horizontal, rather than a vertical direction.

SUMMARY OF THE INVENTION

The launcher of the present invention overcomes the shortcomings of conventional toy rocket launchers by implementing a directional safety valve therein.

The launcher of the present invention provides an advantage of an integrated, directional safety valve for providing a simple, cost efficient and effective apparatus that avoids high velocity launch of a toy rocket in other than a vertical direction.

Further, the present invention provides a launcher of simple and durable construction that can be provided on a single operating platform to facilitate easy storage, transport and packaging, without loss of the safety feature.

The launch pad assembly provides a further advantage of providing a single, self-contained apparatus for storing the bellows, a flexible tube connecting the bellows to the connecting tube, the launch tube and a plurality of toy rockets.

The benefits and advantages of the toy rocket launcher of the present invention can be accomplished by an integrally formed operating platform including a launch pad assembly including an axis about which a launch tube rotates, a connecting tube with a first end connected to a bellows and a second end rotatably connected to the launch tube, and a safety valve formed in an outer circumference of the connecting tube, wherein the safety valve opens to atmosphere as the launch tube is rotated relative to the connecting tube.

BRIEF DESCRIPTION OF THE DRAWINGS

For a better understanding of the invention as well as other objects and further features thereof, reference is made to the following detailed description to be read in conjunction with the accompanying drawings, wherein.

DETAILED DESCRIPTION OF THE PREFERRED EMBODIMENTS

The following detailed description of the preferred embodiments of the invention makes reference to the accompanying drawings. In describing the invention, explanation of related functions or constructions known in the art are omitted for the sake of clearness in understanding the concept of the invention, to avoid obscuring the description of the invention with unnecessary detail.

Figure 1:
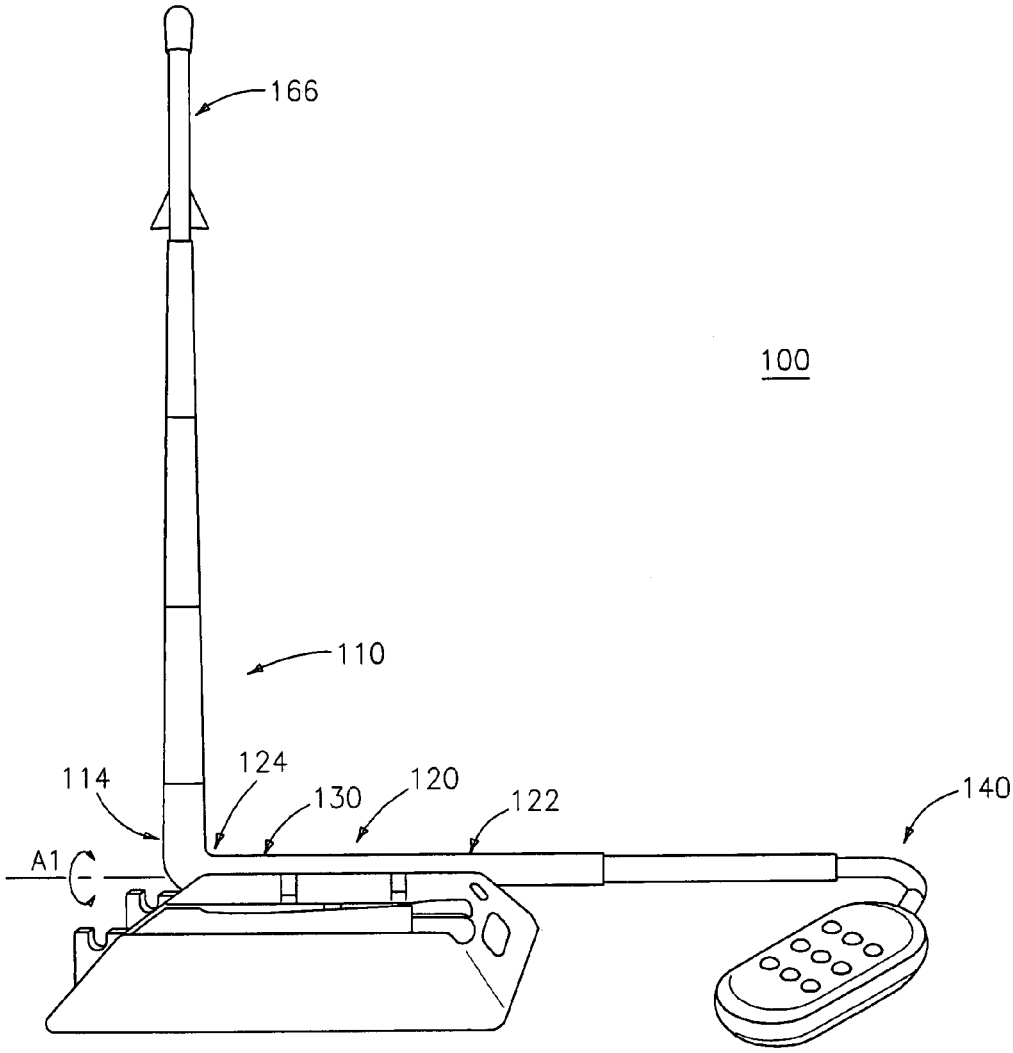
FIG. 1 is a perspective view of the launcher of the present invention.
Figure 2:
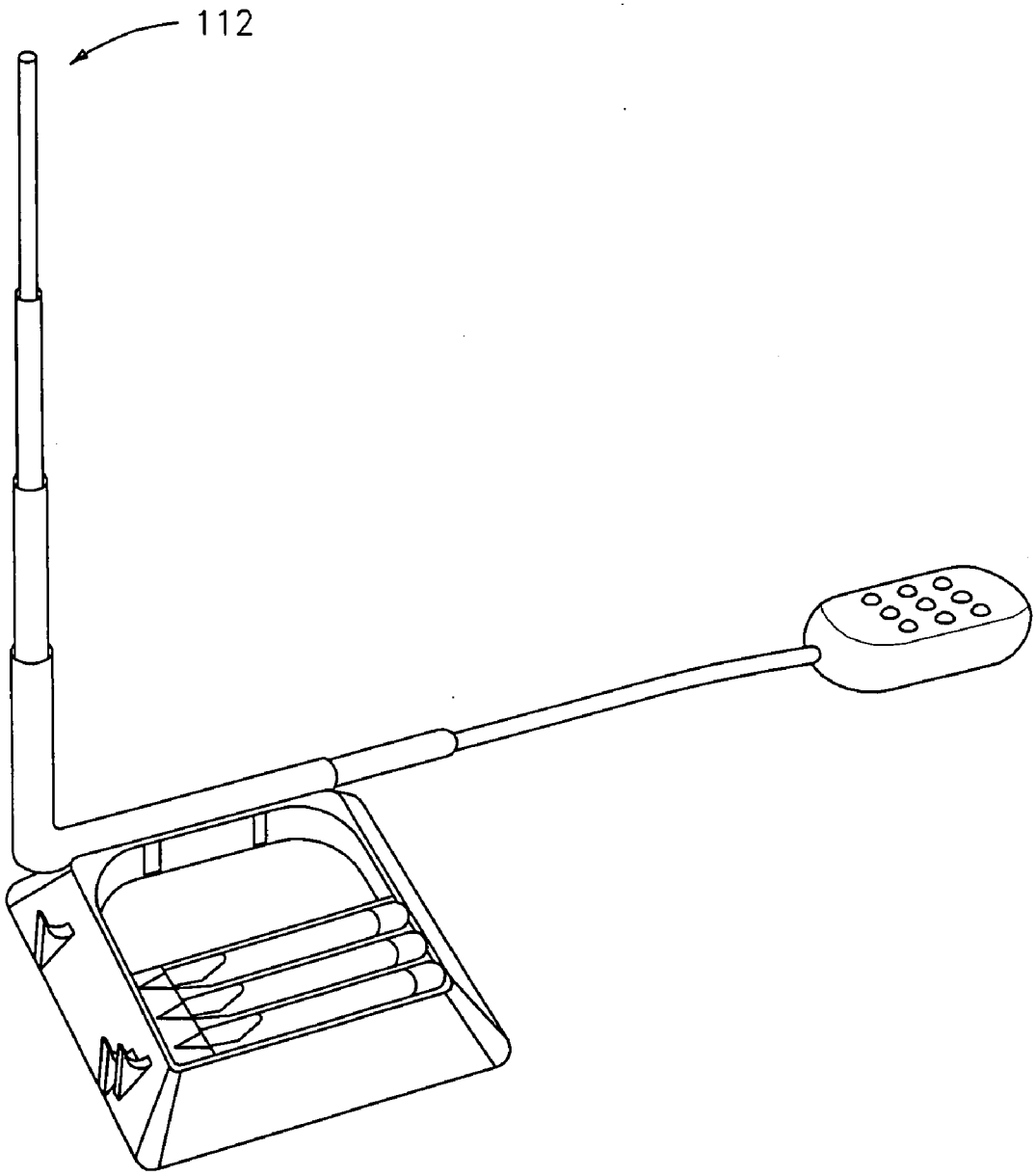
FIG. 2 is another perspective view of the launcher of FIG. 1.

FIGS. 1 and 2 are perspective views of launcher 100 of the present invention. Launcher 100 includes a launch tube 110 rotatable about axis A1. A connecting tube 120 is coaxially provided about axis A1. The connecting tube 120 serves as an air channel by connecting at a first end 122 to a device or chamber, such as a bellows 140, which provides a pressurized pulse of air or water for launching a toy rocket 166 (not shown in FIG. 2).

The connecting tube 120 rotatably connects, at a second end 124 thereof, to the launch tube 110. The rotatable connection between the connecting tube 120 and the launch tube 110 is preferably airtight.

In this preferred embodiment, a proximal end 114 of the launch tube 110 forms a right angle prior to entry into the second end 124 of the connecting tube 120. The end portion of the launch tube 110 is of slightly smaller exterior diameter than the interior diameter of the connection tube 120, allowing the launch tube 110 to fit within the connection tube 120, and providing rotatable engagement.

Figure 3:
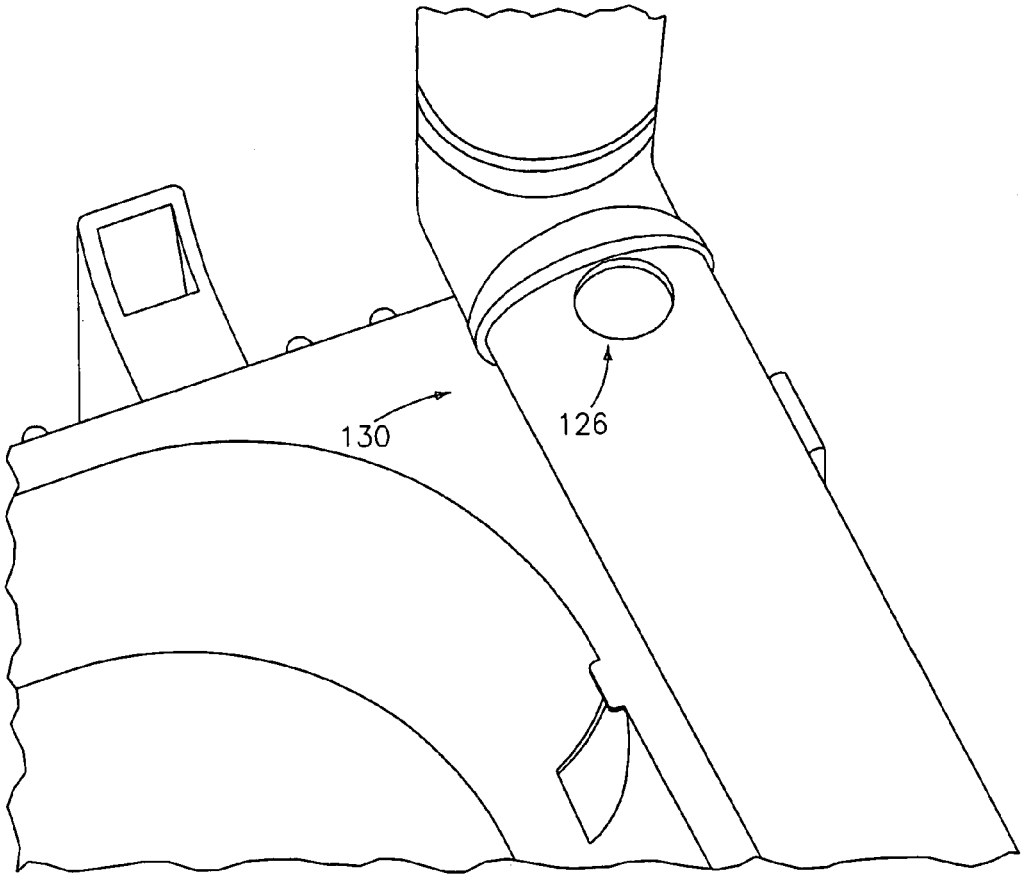
FIG. 3 is a close-up view of the launcher of the present invention, showing the directional safety valve closed to atmosphere.
Figure 4:
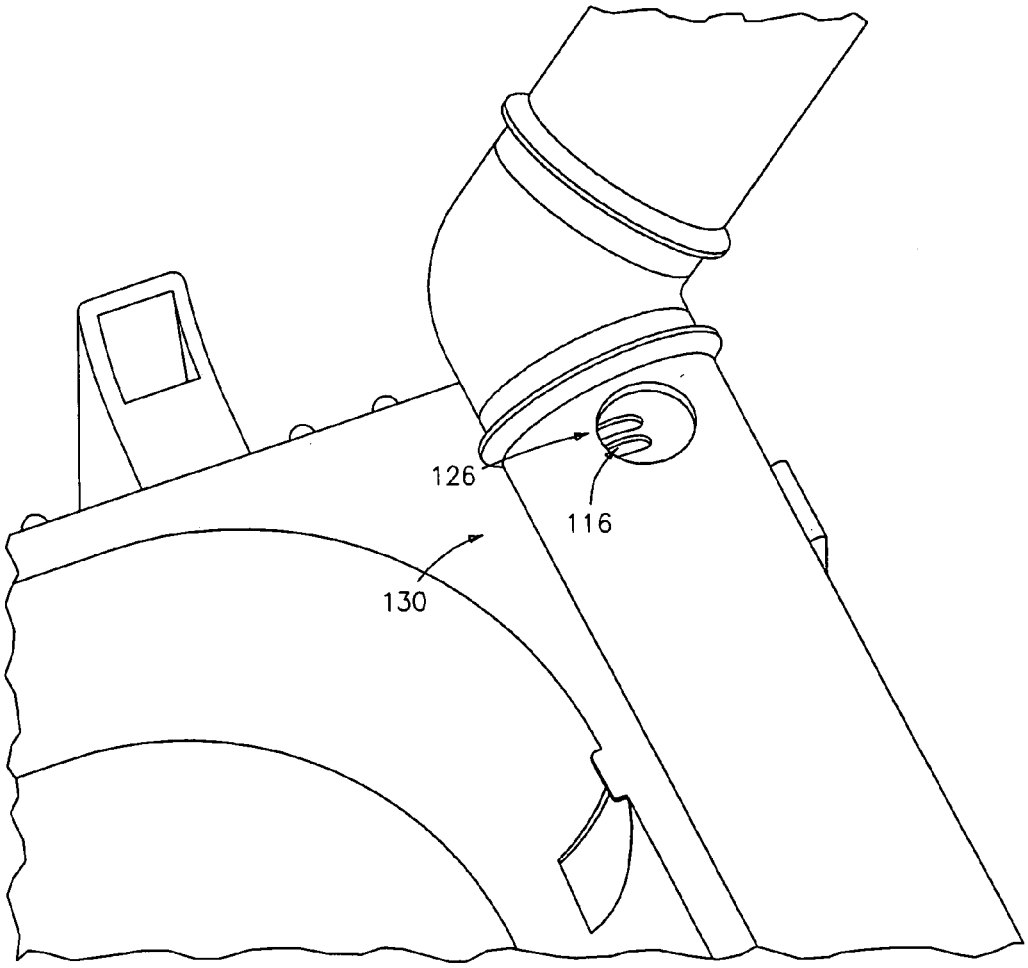
FIG. 4 is another close-up view of the launcher, with the safety valve partially opened to atmosphere.
Figure 5:
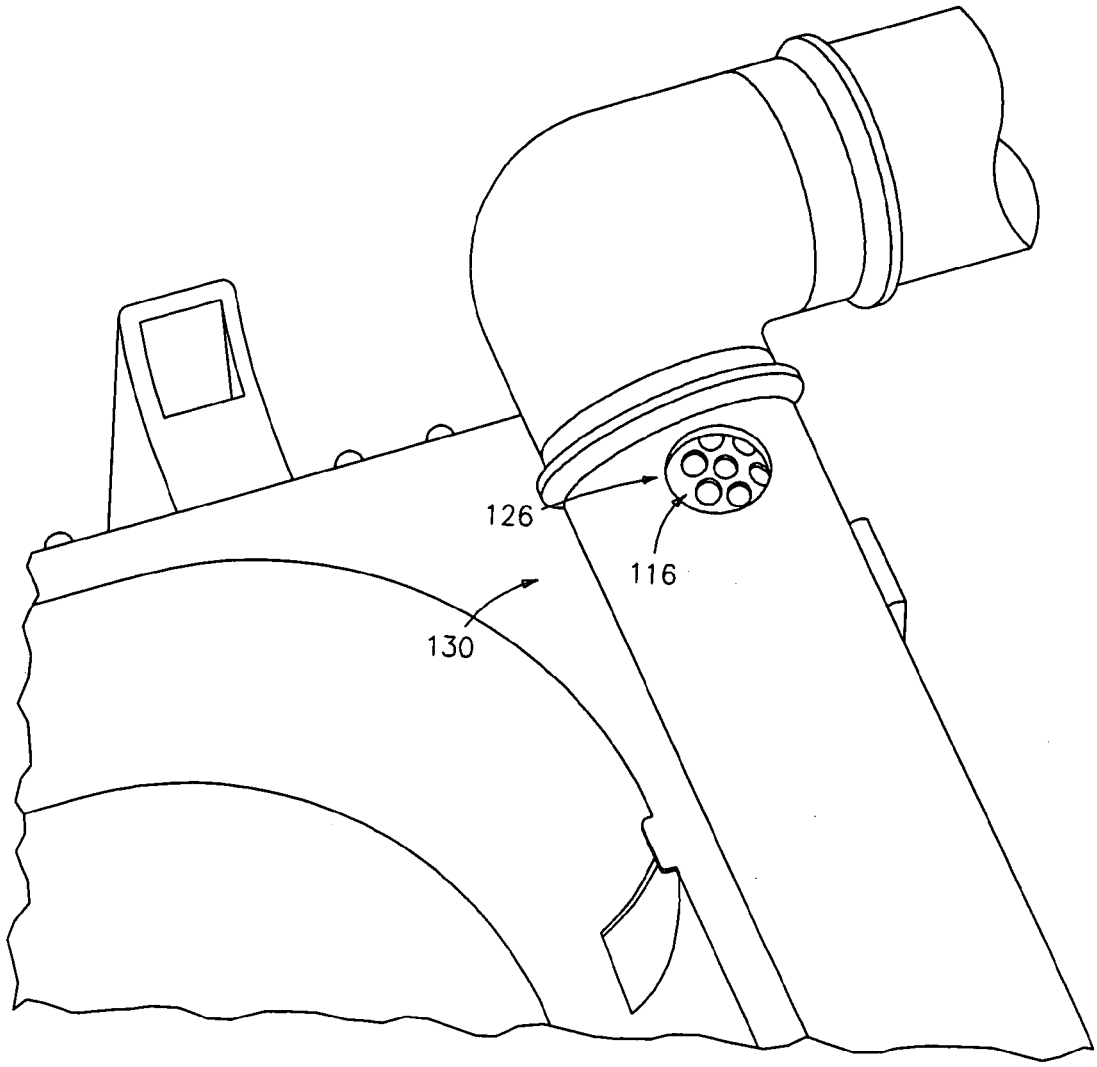
FIG. 5 is yet another close-up view of the launcher, with the safety valve fully opened to atmosphere.

As shown in FIGS. 3–5, at the proximal end 114 portion of the launch tube 110 after the right angle, one or more escapes holes 116 are provided (shown in FIGS. 4 and 5). Escape holes 116 extend through the circumference of launch tube 110, and are preferably coaxially provided about axis A1. The escape holes 116 are not provided around the entire circumference.

FIGS. 3–5 show an atmosphere hole 126 in the connecting tube 120. The atmosphere hole 126 is coaxially provided about axis A1. The atmosphere hole 126 is positioned at a location along axis A1 corresponding to the position of escape holes 116.

Figure 7:
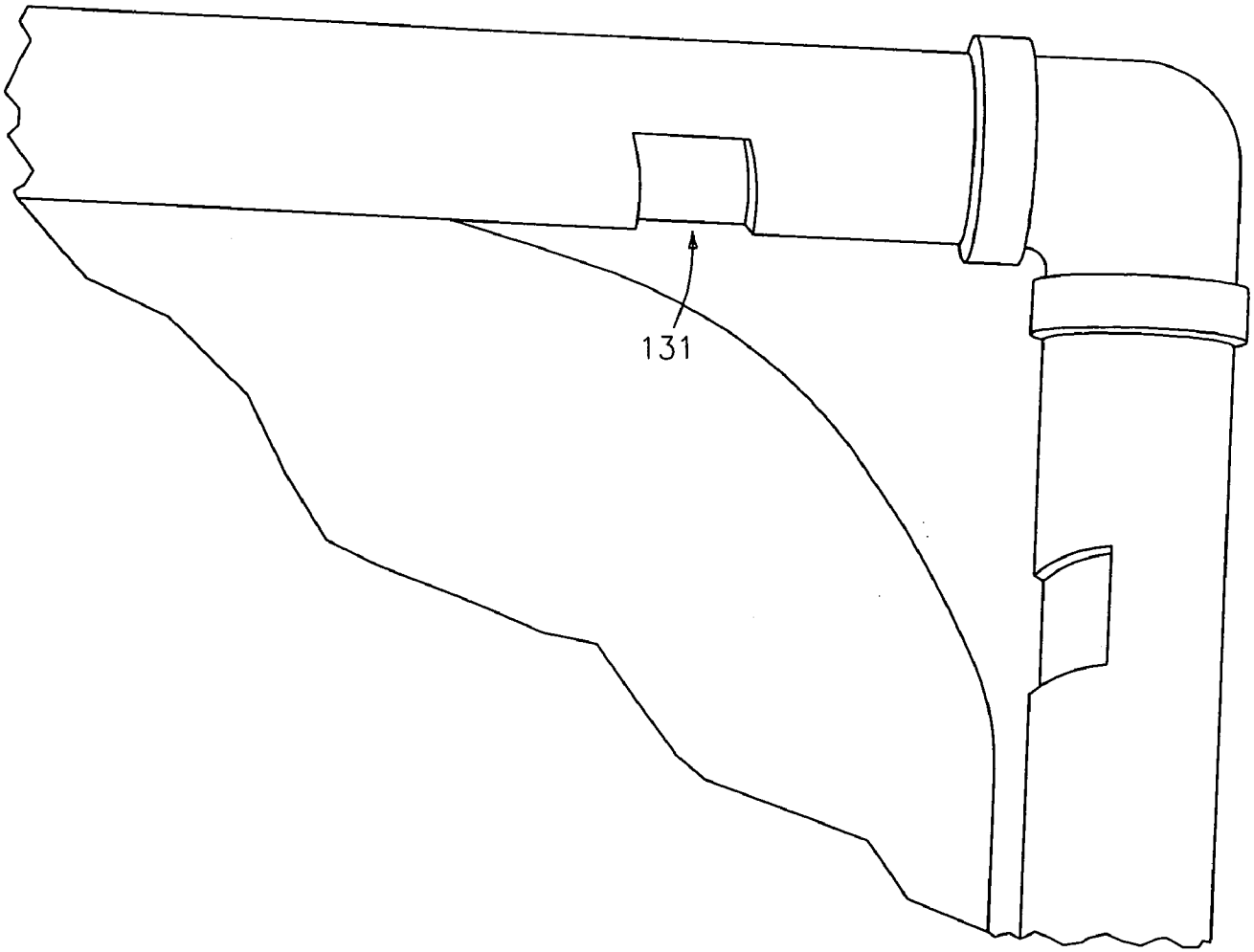
FIG. 7 is a close-up view of the bottom side of the launcher.
Figure 8:
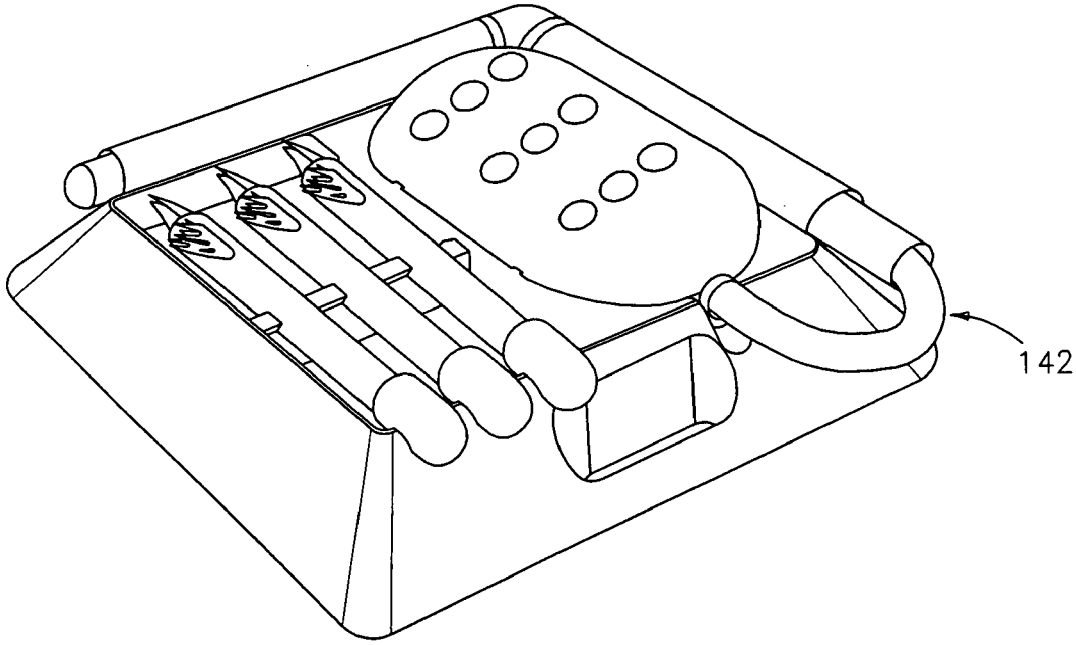
FIG. 8 is a perspective view of the launcher, with all components thereof and a plurality of toy rockets packed into an integrated operating platform.

The combination of the atmosphere hole 126 and the escape holes 116 form safety valve 130, which is provided at an outer circumference of the connecting tube 120. As shown in FIG. 7, which is a close-up view of the bottom side of the launcher, an additional safety valve 131 can be provided at the bottom side of the launcher.

When the launch tube 110 is in a vertical position, i.e. a position perpendicular to the ground or the launch surface, the atmosphere hole 126 and escape holes 116 are not aligned, thereby preventing escape there through of air or liquid when a pressure pulse is channeled by the connecting tube 120 from the bellows 140 to the launch tube 110.

As launch tube 110 rotates away from the vertical position, relative to the launch pad assembly, atmosphere hole 126 and escape holes 116 begin to align, providing a pathway from the interior of the connecting tube 120 to atmosphere. The amount that safety valve 130 opens corresponds to the degree that the launch tube 110 is moved from the vertical position, providing yet another safety advantage.

As shown in FIG. 1, toy rockets 166 are individually loaded onto a distal end 112 of the extended launch tube 110, with the distal end 112 extending into a hollow of toy rocket 166.

The launch tube 110 is preferably constructed of a series of frusto conical sections of descending size, forming an tube when extended to full length, as shown in FIGS. 1 and 2. The bellows 140 is preferably a flexible tube 142 connecting the bellows to the connecting tube. The flexible tube 142 is preferably connected to the first end 122 of the connecting tube 120 by a series of frusto conical sections of descending size, as shown in FIGS. 1 and 2.

Figure 6:
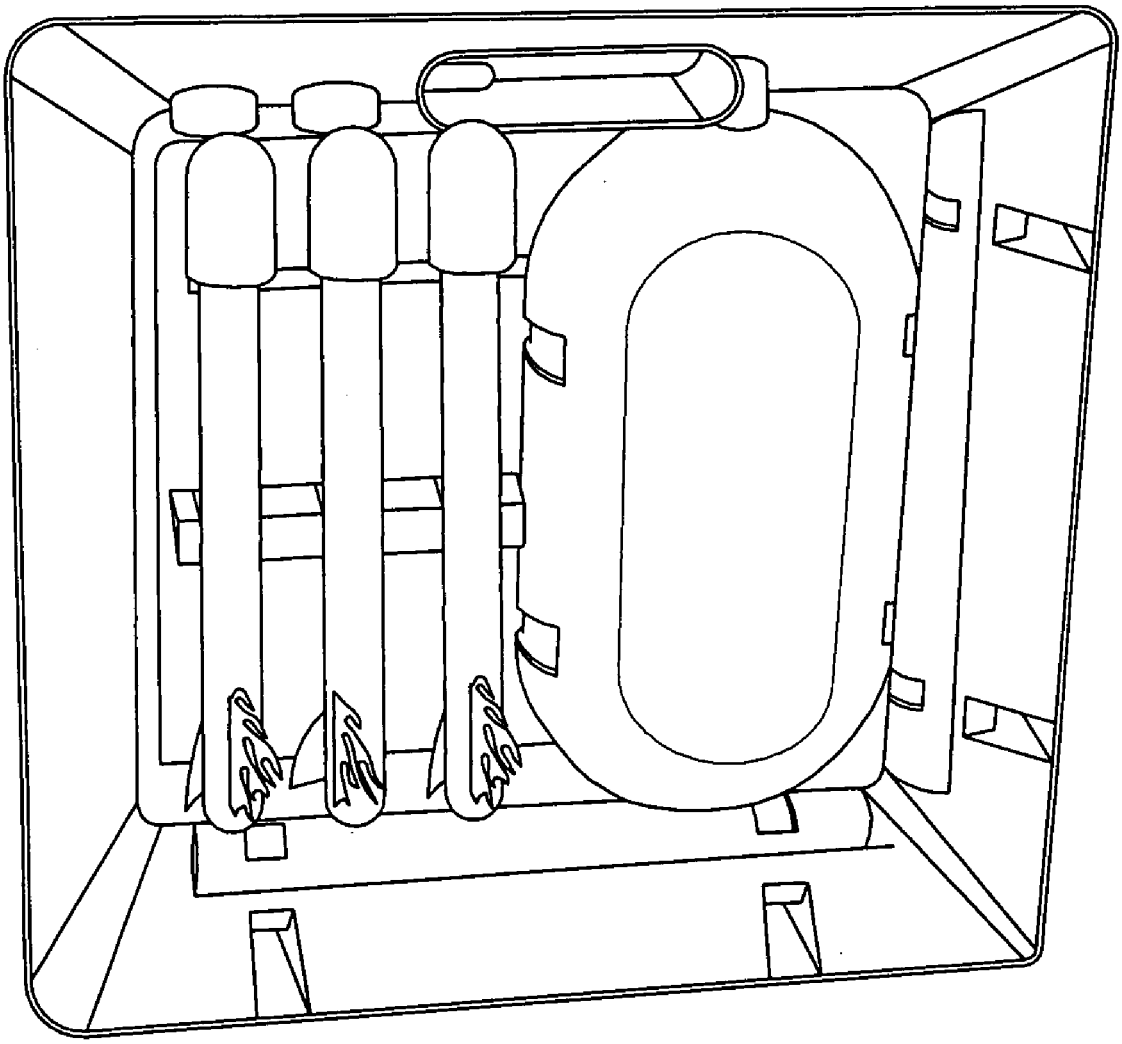
FIG. 6 is a view of a bottom side of the launcher.

As shown, the launch tube can be provided on an integrated operating platform. The integrated platform is useful for providing storage means for a plurality of toy rockets, as shown in FIGS. 1 and 2. As shown in FIG. 6, additional toy rockets can be stored on the bottom side of the operating platform.

While certain embodiments and structures are described herein embodying the invention, it will be obvious to those skilled in the art that various modifications, and re-arrangements of parts can be made without departing from the spirit and scope of the invention, as described by the appended claims.

What is claimed is:

1. A toy rocket launcher comprising:

a launch pad assembly for supporting the launcher on a horizontal surface;

a connecting tube fixedly attached to the launch pad assembly;

a launch tube rotatably attached to a first end of the connecting tube, wherein the launch tube rotates about an axis parallel with the connecting tube;

a bellows connected to a second end of the connecting tube; and a safety valve that opens to atmosphere as the launch tube is rotated away from a vertical orientation, relative to the launch pad assembly.

2. The toy rocket launcher of claim 1, wherein the launch tube is made up of a series of frusto conical sections of descending size, forming a tube when extended.

3. The toy rocket launcher of claim 2, wherein the bellows, the retracted launch tube and a plurality of toy rockets can be stored within the launcher for easy transport.

4. The toy rocket launcher of claim 3, wherein the plurality of toy rockets are individually loaded onto a distal end of the extended launch tube for launching.

5. The toy rocket launcher of claim 1, wherein the safety valve is located on a top side of an outer circumference of the connecting tube.

6. The toy rocket launcher of claim 5, wherein an additional safety valve is provided on a bottom side of the launch pad assembly.

7. A toy rocket launcher comprising:

an axis about which a launch tube rotates, wherein the launch tube is made up of a series of frusto conical sections of descending size;

a connecting tube having an end connected to a bellows and another end of the connecting tube rotatably connected to the launch tube; and a safety valve provided at an outer circumference of the connecting tube, wherein the safety valve allows air discharged from the bellows to vent to atmosphere when the launch tube rotates away from a vertical orientation, relative to a horizontal surface upon with the launcher positioned.

8. The toy rocket launcher of claim 7, wherein a greater amount of air is allowed to vent as the launch tube rotates a greater amount away from the vertical orientation.

9. The toy rocket launcher of claim 8, wherein the connecting tube is formed on a launch pad assembly.

10. The toy rocket launcher of claim 7, wherein the plurality of toy rockets are individually loaded onto a distal end of the launch tube for launching from the launch pad assembly.

11. The toy rocket launcher of claim 7, wherein the safety valve is located on a top side of the outer circumference of the connecting tube.

12. The toy rocket launcher of claim 11, further comprising an additional safety valve on a bottom side of the outer circumference of the connecting tube.

13. A method for launching a toy rocket comprising:

rotating a launch tube about an axis, wherein the axis is parallel with a connecting tube rotatably connected to the launch tube and fixedly connected to a launch pad assembly;

extending the launch tube;

closing a safety valve as the launch tube rotates toward a vertical position, relative to the launch pad assembly;

loading the toy rocket onto a distal end of the extended launch tube; and rapidly compressing a bellows in communication with the launch tube.

14. The method for launching a toy rocket of claim 13, wherein the connecting tube is fixedly connected to a self-contained operating platform, which has preformed regions for storing the bellows and a plurality of toy rockets.

15. The method for launching a toy rocket of claim 14, wherein the launch tube is made up of a series of frusto conical sections.

* * * * *